United States Patent [19]

Schmidt

[11] Patent Number: 4,732,283

[45] Date of Patent: Mar. 22, 1988

[54] SKI RACK

[76] Inventor: Edmund W. Schmidt, 413 Forest Ave., Willow Springs, Ill. 60480

[21] Appl. No.: 869,993

[22] Filed: Jun. 3, 1986

[51] Int. Cl.[4] ..... A47F 7/00

[52] U.S. Cl. ..... 211/70.5; 211/163; 211/181

[58] Field of Search ..... 211/70.5, 163, 205, 211/181; 280/814; 224/717

[56] References Cited

U.S. PATENT DOCUMENTS 2,707,566 5/1955 Eaton et al. ..... 211/163

3,223,247 12/1965 Bleed ..... 211/163

3,502,226 3/1970 Marshack ..... 211/163

3,722,652 3/1973 Busch et al. ..... 211/70.5

*Primary Examiner*—Ramon S. Britts

*Assistant Examiner*—Blair M. Johnson

*Attorney, Agent, or Firm*—Hill, Van Santen, Steadman & Simpson

[57] ABSTRACT

A ski rack for supporting skis in an upright position includes a center frame member and a plurality of modular retaining units each removably secured to the center frame member via roller bearing mounts so that the modules may be readily positioned angularly for easy access.

5 Claims, 5 Drawing Figures

SKI RACK

BACKGROUND OF THE INVENTION

This invention relates generally to apparatus for storing sports equipment and the like. More specifically, this invention relates to racks for retaining and storing skis.

Currently, the most common method for storing snow skis, when they are not being used, is to lean the skis upright against a wall or similar vertical structure. For example, at most ski resorts it is common to see a number of skis leaning up against the outer wall of the lodge.

Of course, this method of storing skis is not only not aesthetically pleasing, but, also can have a detrimental effect on the structure upon which the skis are leaned as well as the skis. This is especially true when the skis are leaned against an interior wall such as in a condominium or lounge area of the lodge. Moreover, because the skis are not designed to be supported against a wall in a vertical position they can easily fall over damaging the skis against the ground or concrete surface upon which they are supported.

Because skiing is a seasonal sport, it is desirable that any ski retaining means used can be easily disassembled so that it can be stored during the warm months. Furthermore, to encourage the use of the ski retaining means, it must be easy to use and require little time to secure or remove the skis. If the ski retaining means requires too much effort people will just lean their skis against a wall.

A further difficulty in constructing a viable ski retaining means is that skis come in a variety of lengths. Due to the bindings on the skis it is difficult to constructed a ski retaining means for skis of varying lengths.

Accordingly, there is a need for a structure for supporting and storing skis.

SUMMARY OF THE INVENTION

A ski rack is provided comprising a center post and at least one modular ski retaining means for supporting at least one pair of skis in an upright position. The modular ski retaining means is constructed so that it can be secured to the center post member. Preferably, the modular ski retaining means is removably secured to the center post. Preferably the ski retaining means is secured to the center post by means that allow the modular ski retaining means to be rotated with respect to the center post.

The modular ski retaining means includes means for removably securing a pair of skis within the modular ski retaining means. Preferably the modular ski retaining means includes a basket at a bottom end for supporting the skis. The modular ski retaining means also preferably, can support at least two pairs of skis. In a preferred embodiment, four modular ski retaining means can be supported on the center post and accordingly, eight pairs of skis can thereby be supported by the ski rack.

Accordingly, it is an advantage of the present invention to provide a rack for supporting a plurality of skis in an upright position.

A further advantage of the present invention is that it provides modular ski retaining units for supporting at least one pair of skis, that are removably secured to a center frame member.

A still further advantage of the present invention is that it provides a modular ski retaining unit that is rotatably secured to a center frame member, is capable of supporting multiple pairs of skis, as well as ski poles and is easily assembled and disassembled, is lightweight and easily transported and can retain skis of varying lengths.

Additionally, an advantage of the present invention is that the ski rack is easy to use and allows one to quickly secure or remove skis.

Additional features and advantages of the present invention are described in and will be apparent from the detailed description of the presently preferred embodiments of the invention and from the drawings.

DETAILED DESCRIPTION OF THE PRESENTLY PREFERRED EMBODIMENTS

The present invention provides a ski rack 10 for supporting skis 12 in an upright manner. To this end, the ski rack 10 includes a center frame member 14 to which a modular retaining unit 16 is secured. Although, the invention is directed to use with snow skis, of course, water skis and the like can also be stored in the ski rack 10 of the present invention.

Figure 1:
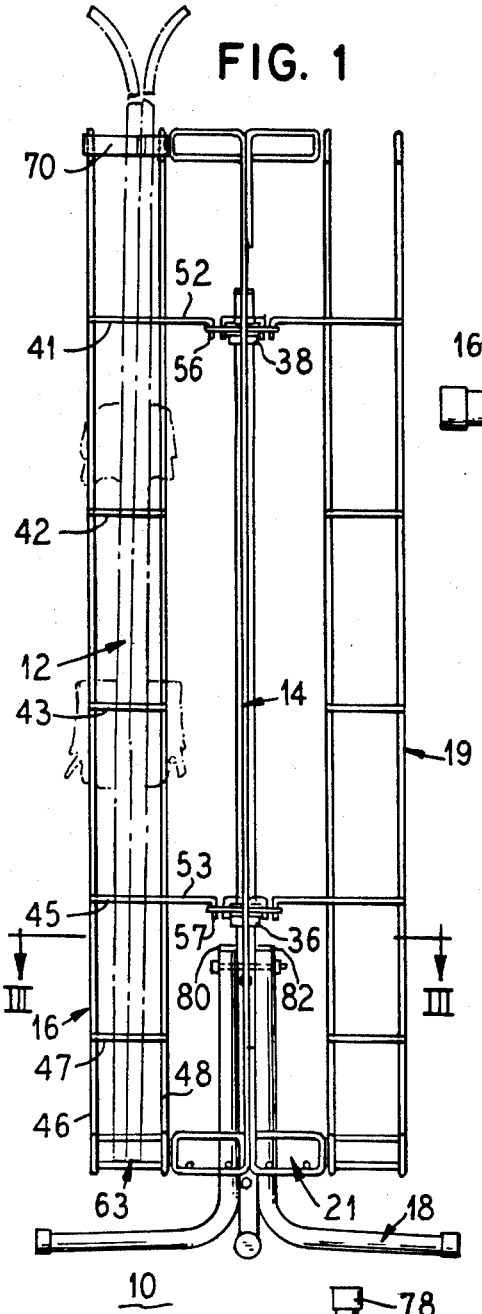
FIG. 1 illustrates a side elevational view of an embodiment of the ski rack of the present invention with a pair of skis supported therein.
Figure 3:
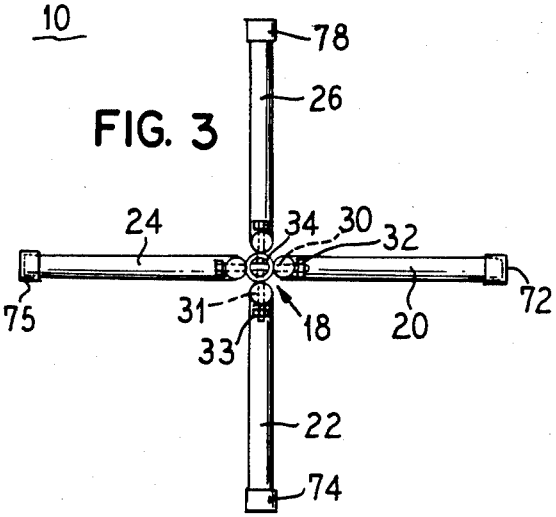
FIG. 3 illustrates a top elevational view of a cross-section of the ski rack of FIG. 1 taken along lines III—III of FIG. 1.

Referring now to FIGS. 1 and 3 which show details of the ski rack 10, the center frame member 14 includes a base member 18 having four legs 20, 22, 24 and 26, thereby to provide a stable support for the ski rack 10 of the present invention.

The legs 20, 22, 24 and 26 of the base member 18 are secured to each other and to a center post 34 in a knock-down assembly by bolts 30 and 31 and nuts 32 and 33. The bolts 30 and 31 are designed to be inserted through an aperture (not shown) in each of the legs 20, 22, 24 and 26 and an aperture (not shown) in the center post member 34. To this end, one bolt 30 bridges legs 20 and 24, and the other bolt 31 bridges legs 22 and 26. Accordingly, the legs 20, 22, 24 and 26 can be disassembled from the center post member 34. This provides a base 18 that is easily assembled or disassembled.

Extending from the base member 18 is an elongated center post member 34. The elongated center post member 34 includes two rotatable bearing members 36 and 38 each having conventional ball bearing members (not shown) that allow the rotatable bearing members 36 and 38 to rotate with respect to the elongated center post member 34, so that the modular retaining unit 16 is allowed to rotate with respect to the center post member 34. The rotatable bearing members 36 and 38 include mounting apertures 40 that are constructed and arranged to receive a portion of the modular retaining unit 16 in selectively removable assembly.

Figure 5:
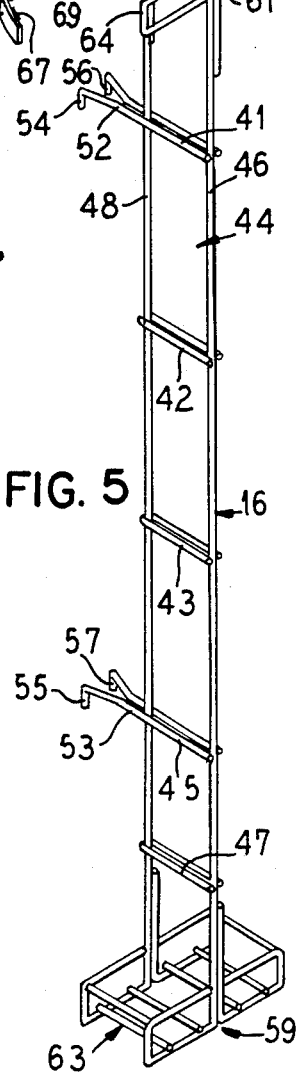
FIG. 5 illustrates a modular retaining unit after it has been removed from the center post of the ski rack of FIG. 1.

Referring now to FIG. 5, the modular retaining unit 16 is illustrated. As illustrated, the modular retaining unit includes a frame member 44. In the embodment illustrated, the frame member 44 is defined by two elongated members 46 and 48 and struts 41, 42, 43, 45 and 47 that bridge the elongated members 46 and 48. Extending from struts 41 and 45 are arm members 52 and 53 which include flange members 54 and 56 and 55 and 57 respectively.

It is contemplated by the present invention that each of the modules 19 be removably mounted and attached to the mounting means 36 and 38 on the center post 14 by interfitting male and female parts that are readily interconnected together and which may, with equal facility, be disconnected selectively.

Figure 4:
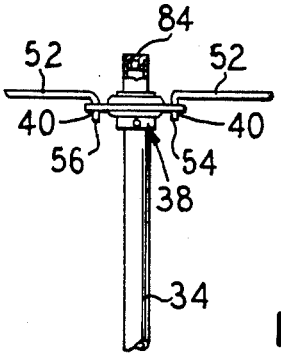
FIG. 4 illustrates a side elevational view of a portion of the top of the ski rack of FIG. 1.

As illustrated in FIG. 4, the flange members 54 and 56 and 55 and 57 constitute male parts are adapted to be received within corresponding apertures 40 providing female parts in the rotatable bearing members 36 and 38. Accordingly, the modular retaining unit 16 is removably secured to the center post 34 simply by connecting or disconnecting the interfitting parts. More specifically, the modular retaining unit 16 can be removed from the center frame unit 14, and specifically the flanges 54 and 56 and 55 and 57 can be removed from the apertures 40 in the rotatable bearing members 36 and 38, by lifting the modular retaining unit upwardly until the flanges disengage the apertures.

The modular retaining unit 16 is made into an elongated element from wire form members and includes a bottom member 59 and top member 61. The bottom member 59 preferably includes means for forming a ski support means which in this exemplary embodiment is provided by two basket members 63. The basket members 63 can be solid, or preferably, as illustrated, can have a mesh-like construction. A mesh-like construction is preferred so that snow and/or water from melted snow can flow through the basket member 63 and not be trapped at the bottom of the basket. If desired, to minimize spotting or puddling, the support means can be absorbent. For example, a sponge is carried by the basket members 63. When the sponge becomes dirty it can be washed or thrown away.

Because the modular retaining unit 16, is secured to the rotatable bearing members 36 and 38, the modular retaining unit 16 is rotatable with respect to the center post member 34. When a user wants to either remove his skis 12 from or place his skis on the ski rack 10 he rotates the modular retaining units to the most convenient access position until he finds the appropriate unit for his skis.

In the preferred embodiment illustrated in FIG. 5, the top 61 of the ski retaining unit 16 includes four retaining means such as bar members 62, 64 and 66 and 68 that extend from the frame member 44. Each pair of bar members 62 and 64 and 66 and 68 respectively, provide a means for allowing straps 65 and 70 respectively, to be secured thereto. To this end, as illustrated, one end of each of the straps 65 and 70 is permanently secured to a bar member 62 and 66 while the other end of each strap is removeably secured to the bar member 64 and 68. Accordingly, a user can removably retain the skis within the ski retaining unit 16 by use of the straps 65 or 70. As illustrated, preferably, the straps have corresponding "VELCRO" brand hooks and retainers embodied in member 67 and 69 that allow the strap to be secured to itself. Of course, other fastening means can be used to removably retain the skis within the modular retaining units 16.

It is contemplated that with the exemplary embodiment shown, each modular retaining unit 16 can support and retain two pairs of skis 12. Thus, the basket 63, the frame 44, and the straps 65 and 70 cooperate so that a pair of skis 12 is supported on each side of the frame 44.

Due to the construction of the modular retaining unit 16, i.e., because only the frame member 44, the straps 65 and 70, and the basket 63, support and retain the skis 12, the modular retaining unit can support a variety of different length skis. The critical obstacle in being able to support skis in the modular retaining unit 16 is the location of the ski bindings. The modular retaining unit of the present invention is constructed so that the bindings can be located anywhere between the basket 63 and the straps 65 and 70. Accordingly, skis of varying lengths can be accommodated and supported in the modular retaining unit 16 without limitation. Moreover, the modular retaining unit 16 is constructed so that the ski poles can also be simultaneously supported.

Figure 2:
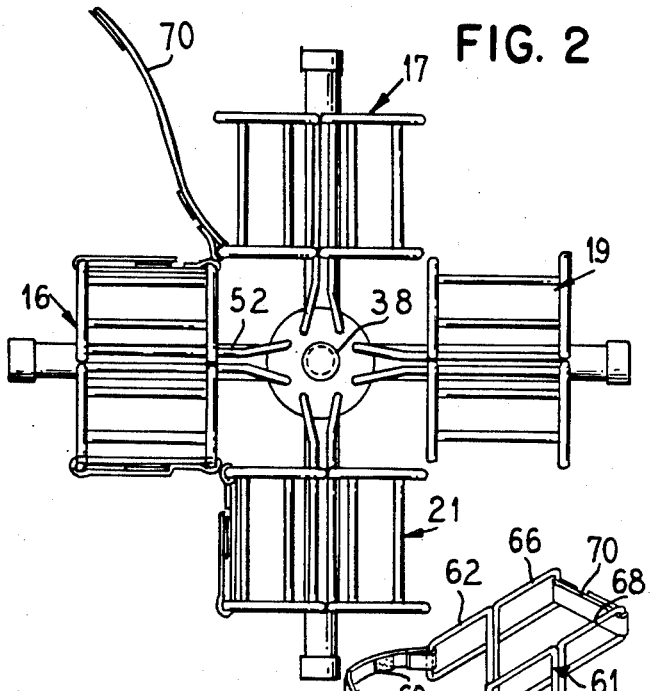
FIG. 2 illustrates a top elevational view of the ski rack of FIG. 1.

Referring now to FIGS. 1 and 2, as illustrated, preferably, four modular retaining units 16, 17, 19 and 21 are secured to the center post member 34. It will be understood that the three other modular retaining units 17, 19 and 21 have the same features of construction as that of the modular retaining unit 16 already described and such description need not be repeated. Because each modular retaining unit 16, 17, 19 and 21 can support and retain two pairs of skis 12, the ski rack 10 can support and retain eight separate pairs of skis 12.

Due to its construction, the ski rack 10 is virtually a knock-down assembly, i.e., it can be easily disassembled or assembled. This is a desirable characteristic for a ski rack because skiing is a seasonal spport and it is desirable to be able to store the ski racks 10 when they are not in use.

Preferably the ski rack 10 is constructed from aluminum or plastic although other suitable materials could be employed without departing from the principles of this invention. Moreover, the center frame 14 can be constructed from aluminum and the modular retaining units 16, 17, 19 and 21 can be constructed from plastic. If the center frame member 14 is constructed from aluminum, preferably the center frame member will include plastic caps 72, 74, 75, 78, 80, 82 and 84. The plastic caps 72, 74, 75, 78, 80, 82 and 84 prevent snow and other moisture from getting into the hollow aluminum structure.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A ski rack comprising:

a stationary center post;

rotatable vertically spaced mounting means carried by said post;

a plurality of retaining means modules for supporting at least one pair of skis in an upright position in each module and each said retaining means module comprising elongated wire form members including a bottom member forming ski supporting dual baskets and further including a top member forming corresponding dual retainer bars and each having straps for selectively securing an upright ski in said module parallel to said center post; and interfitting male and female parts between each said mounting means and each said module for selectively connecting and disconnecting said modules to said center post in relatively rotatable assembly.

2. The ski rack of claim 1 wherein the mounting means has roller bearing means and is rotatably secured to the center post so that said modules may be angularly adjusted for convenient access.

3. The ski rack of claim 1 wherein the retaining means modules includes locking means for securing the skis within the retaining means modules in selectively removable assembly therewith.

4. A ski rack for supporting a plurality of pairs of skis in an upright position comprising:

a center frame member including a base and at least one rotatable bearing member;

a plurality of vertically extending modular retaining units including an elongated frame member having a basket at the lower end thereof and a strap at the upper end thereof and substantially vertically aligned with said basket, the basket, elongated frame member, and strap cooperating to removably support a pair of skis in an upright position;

said frame including at least one flange member that is removably received by said rotatable bearing member, whereby skis may be selectively stored and removed from said rack.

5. A knock-down ski rack assembly for seasonal use in homes, lodges and shelters comprising:

a support stand having an upright tube forming a center pole and a plurality of angularly bent tubes connected thereto and extending radially outwardly in circumferentially spaced relation to one another to support the stand firmly on a support surface; upper and lower first mounting means vertically spaced from one another on said center pole;

each said first mounting means having roller bearings for mounting said mounting means on said center pole for selective rotation; and each said first mounting means having spaced aperture recess means formed therein at angularly spaced locations forming female sockets for receiving a corresponding number of male counterparts;

and a plurality of removable modules, each comprising a vertically oriented elongated part made of wire-form elements and forming a basket-like configuration at the lower end thereof and having a fastening member at its upper end thereof, each said module having upper and lower second mounting means each formed with a projecting male part adapted to be received in a corresponding one of said female sockets in said first mounting means, whereby said modules may be selectively connected and disconnected from said center pole, said basket and fastening member of each module being substantially vertically aligned, the entire assembly being rotatable on said stationary support stand for angularly positioning the modules in a convenient access location.

* * * * *